US005083548A

United States Patent [19]

Parrillo, Jr.

[11] Patent Number: 5,083,548

[45] Date of Patent: Jan. 28, 1992

[54] HURRICANE EFFECT

[76] Inventor: Robert A. Parrillo, Jr., 1666 Eagles Pl. E-101, Rock Hill, S.C. 29730

[21] Appl. No.: 556,668

[22] Filed: Nov. 6, 1990

[51] Int. Cl.[5] ..... F02M 29/02

[52] U.S. Cl. ..... 123/592; 48/189.5

[58] Field of Search ..... 123/590, 592; 48/180.1, 48/187, 189.4, 189.5

[56] References Cited

U.S. PATENT DOCUMENTS

| | | | |
|---|---|---|---|
| 1,156,716 | 10/1915 | Shores | 123/592 X |
| 1,885,697 | 11/1932 | Fabbro | 123/592 |
| 2,437,183 | 3/1948 | Berg | 123/592 X |
| 2,969,782 | 1/1961 | Falzone | 123/592 X |
| 3,847,128 | 11/1974 | Palotsee | 123/592 |
| 3,945,361 | 3/1976 | Piotrowicz, Sr. | 123/592 X |
| 4,059,082 | 11/1977 | McCauley | 123/592 X |
| 4,080,943 | 3/1978 | Carr et al. | 123/592 |

FOREIGN PATENT DOCUMENTS

| | | | |
|---|---|---|---|
| 0169136 | 8/1934 | Switzerland | 123/592 |
| 0358334 | 10/1931 | United Kingdom | 123/592 |

*Primary Examiner*—Willis R. Wolfe

[57] ABSTRACT

The benefits of "The Hurricane Effect" are increased performance, increased consistency of that performance, a reduction of fuel consumption, and reduced toxic emissions from unburned or partially burned fuels. The "Hurricane Effect" weakens the molecular bonding of any given fuel by a series of various components that create the atmospheric conditions of a hurricane within the intake manifold of any internal combustion engine. The "Hurricane Effect" is guaranteed to evenly distribute fuel molecules among air molecules in preparation for burn.

23 Claims, 2 Drawing Sheets

Gear Assemblies
Electric Motors
I-A
I-B.
I-C.
I-D
Intence Vacuum
Extreme Turbulance
II-E.
II-F.
H.
H.
G.
H.
H.

HURRICANE EFFECT

BACKGROUND OF INVENTION

Starting with the basic scientific research and testing of my keen observation, utilizing a simple diamond steel mesh screen, I noticed the effect it had on improving horsepower and fuel economy. I then experimented with various blade types and had favorable results.

Examining the Patent files with-in the Public Search Room, I notice many devices all doing one basic function that none of them alone seemed to perform at the greatest possible degree. The effect that has been missing throughout all previously patented materials was the that of developing the vacuum great enough to attack and weaken the molecular bonding of the fuel to be vaporized, before performing the various tasks of heating, beating and magnetizing. The Hurricane Effect came about by my observation of the real effects of a true hurricane. I simply put two and two together, and thus; the Hurricane Effect.

SUMMARY OF INVENTION

The "Hurricane Effect" is the absence of air pressure that is caused by a natural hurricane or tornado. I was fascinated that a soda straw is blown through a palm tree because the molecular bonding in the tree is weakened by the absence of the normal atmospheric pressure caused by the storm. The plastic soda straw, being blown by the high speed winds, has a different molecular structure and bonding that only a vacuum could weaken equal to that of the tree; therefore the wind can thrust the straw through the tree. I have discovered that the fuel molecules bonding will also be weakened by the same atmospheric conditions when they are created within an intake manifold; creating the most favorable environment to vaporize fuel in preparation for burn.

The function of "The Hurricane Effect" is to completely and effectively distribute individual molecules of fuel amidst the air molecules during the intake process for any fuel burning system. Because it creates the same type of atmospheric conditions found in a natural hurricane with-in an intake manifold in order to vaporize fuel, I call this invention, "The Hurricane Effect".

BRIEF DESCRIPTION OF DRAWING

These drawings demonstrate the specified lay-out of components that create "The Hurricane Effect" with-in an enclosed manifold. Scale and design factors have been excluded, due to their irrelevance to the function of "The Hurricane Effect".

In FIGS. (1) and (2), the basic concept of "The Hurricane Effect" is achieved. These impellers may be applied in any given situation, set for any given speed, and designed to vaporize any given amount of fuel.

Figure 1:
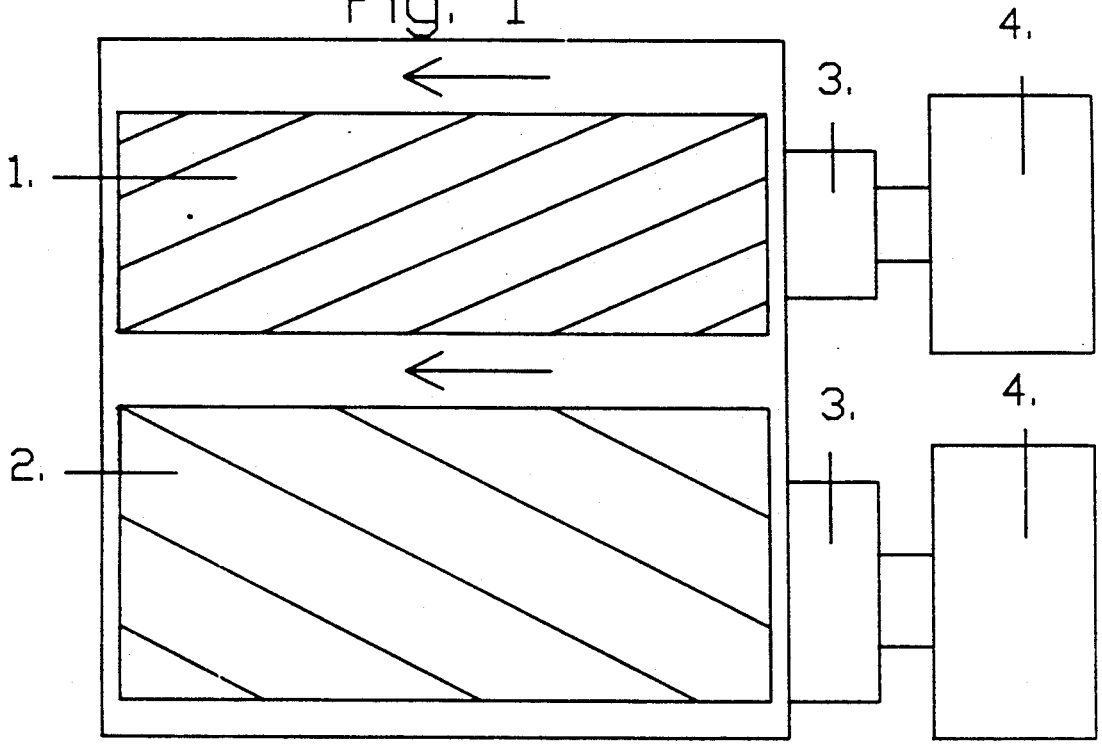
Figure 2:
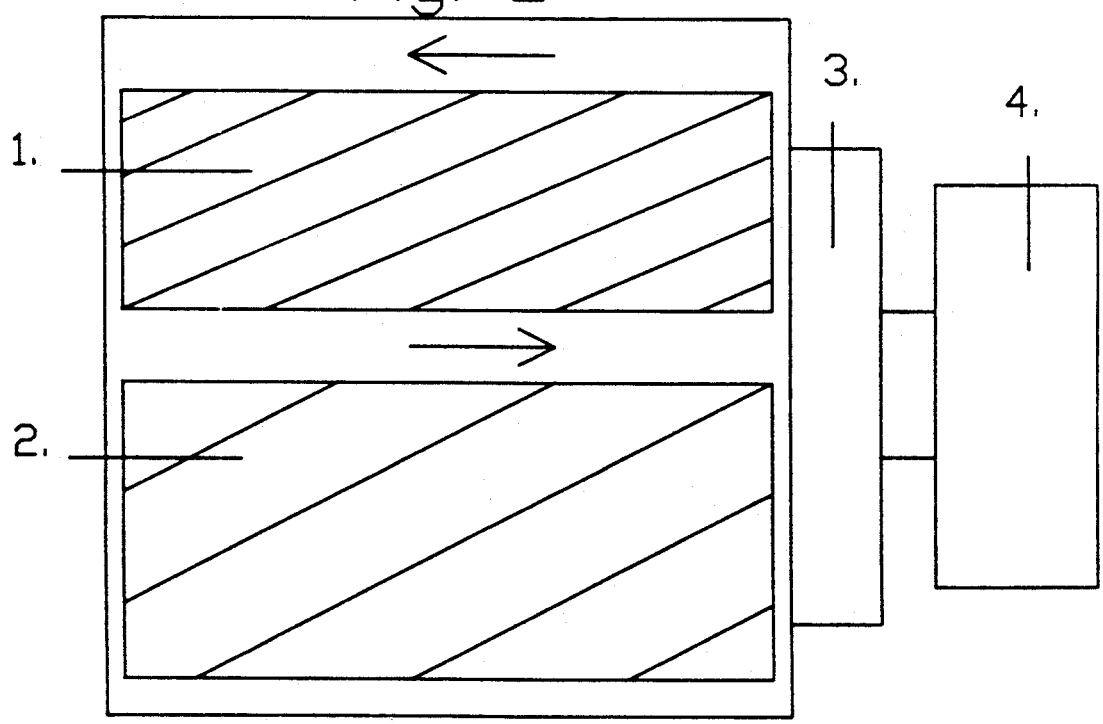
Figure 3:
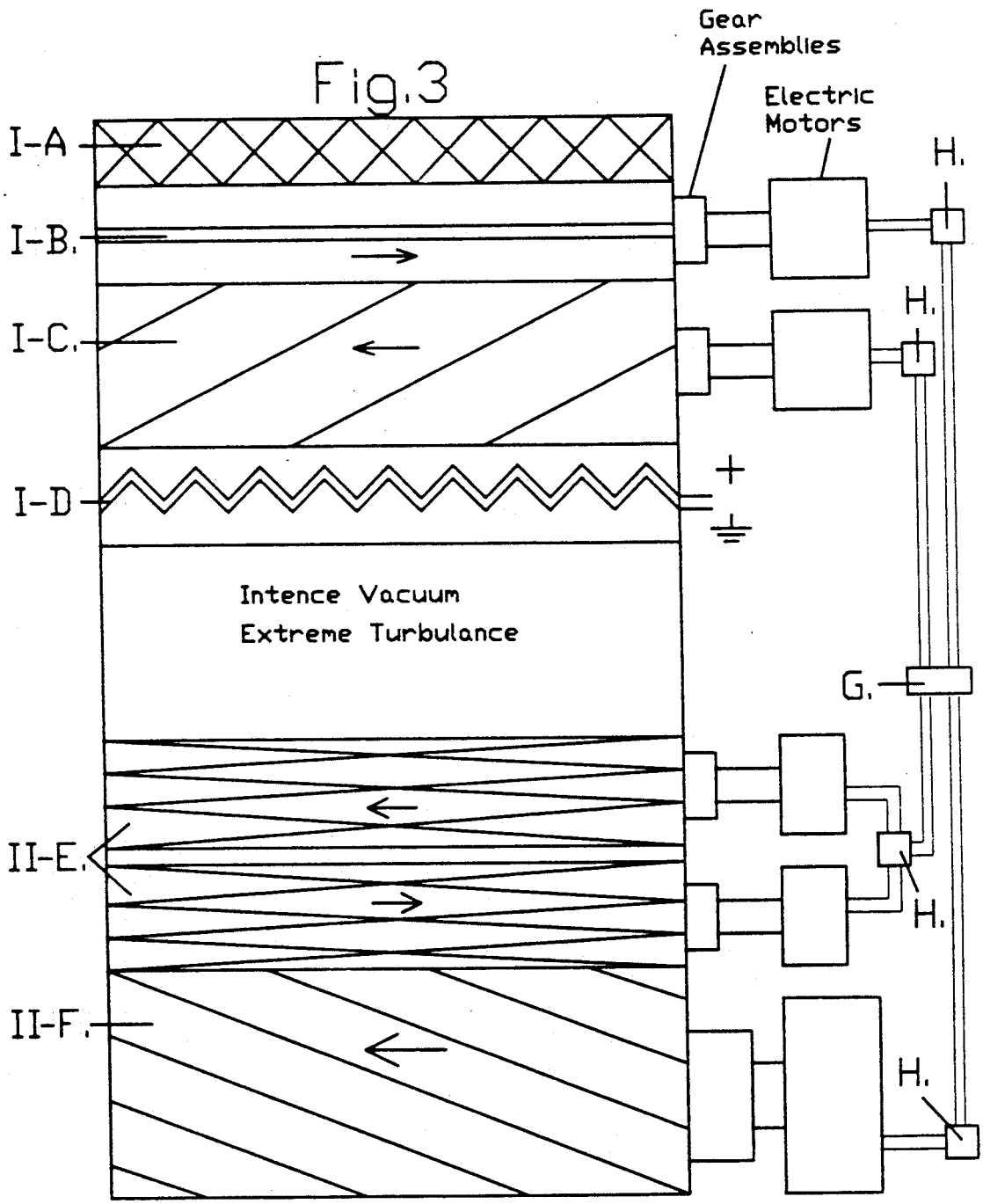

FIG. (3) is an example of the benefits of "The Hurricane Effect". This model is intended to reflect the basic layout of components to be used in racing, due to the rapid and high-volume of fuel to be processed; however, it is important to note that with applications implementing fuel injection between said stage 1 and said stage 2, the break-up beaters and the compensation impellers, (Section 2), will be located between the fuel injectors and the intake valve; therefore, there will need to be smaller scale versions of these components, one in each intake port, for as many intake ports as there are in a given engine.

FIG. (3) Section 1, (A–D), depicts the components whose function changes with adding fuel prior to stage 1 as specified in claim (12). Section 2, (E and F), depicts the components whose function is the same whether adding metered fuel prior to stage 1 or adding metered fuel between said stage 1 and stage 2 as specified in claim (13). Adjustment of each individual component may be achieved by a regulator, (H) which fluctuates the amount of electricity flowing to electric motor/gear assembly.

When adding metered fuel between said stage 1 and stage 2, Section 1 will be dealing with intake air alone, preparing the intake atmosphere for the vaporization process to be completed by Section 2. When adding metered fuel prior to said stage 1, Section 1 will be mixing air with fuel as well as Section 2.

A throttle anticipation switch,(G) is incorporated to increase and decrease the speeds of components B,C,E, and F, according to throttle position.

These drawings are intended to be used as only a reference for obtaining a knowledge of the individual components operations, and function as they relate to the over-all function of "The Hurricane Effect" as a whole.

DETAILED DESCRIPTION OF DRAWINGS

FIG. 1

FIG. (1) is the schematic example of impellers that spin the same direction, but have blades in opposing directions.

1. Reverse action impeller gear driven by electro-mechanical means independently of 2.
2. Compensation impeller gear driven by electro-mechanical means independently of 1.
3. Individual gear box for 1, and 2.
4. Individual electric motors for 1, and 2.

FIG. 2

FIG. (2) is the schematic example of impellers that spin in opposite directions, but have blades in same direction.

1. Reverse action impeller gear-driven by electro-mechanical means connected by series of gears to motor and section 2.
2. Compensation impeller gear-driven by electro-mechanical means connected by a series of gears to motor and section 1.
3. Unified gear box for section 1, and 2.
4. Single electric motor drives both section 1, and 2.

FIG. 3

Section 1: (A) through (D)

A. Restriction Screen:

The portion of operation this component contributes to the overall function of the "The Hurricane Effect" is protecting components (A–F) from foreign debris. It will also assist in creating restriction and turbulence.

B. Electro-mechanically Driven Restriction Beaters:

The portion of operation this component contributes to the overall function of the "The Hurricane Effect" is primarily to impact large molecular conglomerations of a fuel when adding metered fuel prior to said stage one; breaking-up the larger fuel droplets. It will also be adding to the restriction, and turbulence within the confines of an intake manifold. Spinning in opposite direction of the reverse-action, gear-driven impeller assembly, it may also be mixing fuels. It will be recieving air/fuel combinations from (A) on its' way to (C).

C. Reverse Action Gear Driven Impeller Assembly:

The portion of operation this component contributes to the overall function of the "The Hurricane Effect" is increasing vacuum by spinning at a high rate of speed and propelling with great force against the flow of intake being drawn by the compensation impeller assembly (F). This component will be producing the majority of vacuum and turbulance between its location and the compensation impeller assembly (F). It will also be breaking up molecular conglomerations of a fuel, and/or mixing fuels, when adding metered fuel prior to said stage one, receiving intake from (B) on its' way to (D).

D. Heater Plate with an Adjustable In-Cockpit Thermostat and Temperature Gauge:

The portion of operation this component contributes to the over-all function of the "The Hurricane Effect is heating the air or air/fuel combination to the point at which the fuel molecules become most excited and easily separable. This example does not depict the adjuster for controlling the temperature of the heating elements according to the environmental conditions. It will also be creating restriction, and turbulence, breaking-up molecular conglomerations of a fuel, and/or mixing fuels when adding metered fuel prior to said stage one. It will be mixing, restricting and heating air only when adding metered fuel between said stage 1 and said stage 2; receiving intake from (C) on its' way to (E). Section 2; (E) & (F)

E. Pair of Break-up Beaters:

The portion of operation these components contribute to the overall function of the "The Hurricane Effect" is impacting the fuel molecules at a high speed and with significant velocity. Spinning in opposite directions, increasing turbulence and restriction characteristics as they break-up small molecular conglomerations of a fuel, and/or mix fuels while the molecular bonding of the given fuel(s) is in its' weakest state; the latter of the two spinning in the opposite direction of the compensation impeller assembly (said stage 2) here shown as (F). Receiving intake from (D) on its' way to (F).

F. Compensation Impeller Assembly:

The portion of operation this component contributes to the overall function of the "The Hurricane Effect" is drawing the air or air/fuel combination through the components A-E. It will dictate the direction of intake flow with a specified speed, and with significant velocity to compensate the restriction of components (A-E), preparing the vaporized air/fuel mixture with desired compression, receiving intake from (E) sending it to the location desired for burn, as specified rate.

G. Throttle Anticipation Switch:

The portion of operation this switch contributes to the overall function of the "The Hurricane Effect" is to transferring enough electricity to the electric motors driving components B,C,E, and F, to maintain a general idle speed as engine throttle is in idle position; as engine throttle is actuated to permit acceleration, it will be transferring enough electricity to accelerate components B,C,E, and F, to a higher speed in order to effectually vaporize the proportioned amount of fuel.

H. Adjustment Controls:

The portion of operation these components contribute to the overall function of the "The Hurricane Effect is enabling adjustment of each components' individual operation. These adjustments are for fine tuning "The Hurricane Effect" for optimum performance in various weather, atmospheric, environmental, and working conditions.

I claim:

1. A process of atomizing fuel in preparation for burning consisting of a first stage protection screen/mesh material for filtering debris out of the incoming air, a second stage beater assembly for breaking up large conglomerations of fuel molecules, a third stage reverse action impeller assembly for creating an intense vacuum and extreme turbulence, a fourth stage heating means for generating the most favorable temperature for fuel vaporization, a fifth stage dual beater assembly for further breaking up the remaining small conglomerations of fuel, and a sixth stage compensation impeller assembly for drawing the fuel/air mixture through the previous stages.

2. A device for atomizing fuel in preparation for burning comprising a first section protection screen/mesh type material, a second section beater assembly, a third section reverse action impeller assembly, a fourth section heating means, a fifth section dual beater assembly comprising at least two impellers spinning in opposite directions from each other, and a sixth section compensation impeller assembly.

3. A process of atomizing fuel/air mixture combinations in preparation for burning utilizing a first stage reverse action impeller assembly creating an intense vacuum and extreme turbulence between said first stage and a second stage compensation impeller assembly which draws fuel/air mixture through said first stage impeller assembly.

4. An atomizing process as set forth in claim 3 implementing a screen/mesh type material for protecting the impeller assemblies from foreign debris.

5. An atomizing process as set forth in claim 3 implementing an initial beater assembly for breaking up large conglomerations of fuel molecules prior to said first stage impeller assembly.

6. An atomizing process as set forth in claim 3 implementing a heating means for generating a sufficient temperature to vaporize the fuel.

7. An atomizing process as set forth in claim 3 implementing a second beater assembly prior to said second stage compensation impeller assembly for breaking up small conglomerations of fuel molecules.

8. An atomizing process as set forth in claim 3 wherein metered fuel is added prior to said first stage.

9. An atomizing process as set forth in claim 3 wherein metered fuel is added between said first stage and said second stage.

10. An atomizing process as set forth in claim 3 implementing a pair of beater assemblies spinning in opposite directions of each other between said first stage and said second stage.

11. A device for atomizing fuel/air mixture in preparation for burning comprising a first section containing a reverse action impeller assembly for creating an intense vacuum and extreme turbulence between said first section and a second section which comprises a compensation impeller assembly which draws fuel/air mixture through said first section.

12. A device for atomizing fuel/air mixture in preparation for burning as set forth in claim 11 further comprising a screen/mesh type material before the first section for protecting the impeller assemblies from foreign debris.

13. A device for atomizing fuel/air mixture in preparation for burning as set forth in claim 11 further comprising an initial beater assembly to for breaking up large conglomerations of fuel molecules prior to said first section impeller assembly.

14. A device for atomizing fuel/air mixture in preparation for burning as set forth in claim 11 further comprising a heating means for generating a sufficient temperature to vaporize the fuel.

15. A device for atomizing fuel/air mixture in preparation for burning as set forth in claim 11 further comprising a second beater assembly prior to said second section compensation impeller assembly for breaking up small conglomerations of fuel molecules.

16. A device for atomizing fuel/air mixture in preparation for burning as set forth in claim 11 further comprising means for adding metered fuel prior to said first section.

17. A device for atomizing fuel/air mixture in preparation for burning as set forth in claim 11 further comprising means for adding metered fuel between said first section and said second section.

18. A device for atomizing fuel/air mixture in preparation for burning as set forth in claim 11 further comprising a pair of beater assemblies spinning in opposite directions of each other between said first and said second sections.

19. A device for atomizing fuel/air mixture in preparation for burning as set forth in claim 11 further comprising means for generating an electro-magnetic field.

20. A device for atomizing fuel/air mixture in preparation for burning as set forth in claim 11 further comprising a blower type supercharger after the second section.

21. A device for atomizing fuel/air mixture in preparation for burning as set forth in claim 11 wherein said second section comprises a turbo-charging impeller means.

22. A device for atomizing fuel/air mixture in preparation for burning as set forth in claim 11 further comprising adjustable electro-mechanical means to drive the impeller assemblies.

23. A device for atomizing fuel/air mixture in preparation for burning as set forth in claim 11 further comprising mechanical means for driving the impeller assemblies.

* * * * *